US010837215B2

(12) United States Patent
Schmidt et al.

(10) Patent No.: US 10,837,215 B2
(45) Date of Patent: Nov. 17, 2020

(54) ZONE OBJECT DETECTION SYSTEM FOR ELEVATOR SYSTEM

(71) Applicant: OTIS ELEVATOR COMPANY, Farmington, CT (US)

(72) Inventors: Walter Thomas Schmidt, Marlborough, CT (US); Enrico Manes, Feeding Hills, MA (US); Michael J. Tracey, Cromwell, CT (US); Norbert Antony Murray Hootsmans, South Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 254 days.

(21) Appl. No.: 15/984,909

(22) Filed: May 21, 2018

(65) Prior Publication Data

US 2019/0352955 A1 Nov. 21, 2019

(51) Int. Cl.
*E05F 15/73* (2015.01)
*E05F 15/43* (2015.01)
(Continued)

(52) U.S. Cl.
CPC ..... *E05F 15/73* (2015.01); *B66B 13/146* (2013.01); *B66B 13/26* (2013.01); *E05F 15/43* (2015.01);
(Continued)

(58) Field of Classification Search
CPC ..... B66B 13/26; E05F 15/73; E05F 15/43; E05F 2015/434; E05F 2015/763;
(Continued)

(56) References Cited

U.S. PATENT DOCUMENTS 3,903,996 A * 9/1975 Berkovitz ..... B66B 13/26 187/316
4,029,176 A * 6/1977 Mills ..... B66B 13/26 187/317

(Continued)

FOREIGN PATENT DOCUMENTS

CN 106044502 A 10/2016
EP 2410115 A1 1/2012

OTHER PUBLICATIONS

Telcosensors, Spacemotion Series, SMM01, 4 pgs., www.telcosensors.com, retrieved from the internet Apr. 12, 2018.

(Continued)

*Primary Examiner* — Justin B Rephann
(74) *Attorney, Agent, or Firm* — Cantor Colburn LLP

(57) ABSTRACT

A zone object detection system including a passenger compartment. Also included is a door moveable between an opened position and a closed position. Further included is a first sensor monitoring a first zone outside of a plane of the door. Yet further included is a second sensor monitoring a second zone comprising at least one of the plane of the door and outside of the plane of the door. Also included is a controller in operative communication with the first sensor and the second sensor, the controller commanding a first modification of a door closing movement of the door if an object is detected in the first zone, the controller commanding a second modification of the door closing movement of the door if an object is detected in the second zone.

16 Claims, 2 Drawing Sheets

(51) Int. Cl.
*B66B 13/26* (2006.01)
*B66B 13/14* (2006.01)

(52) U.S. Cl.
CPC ... *E05F 2015/765* (2015.01); *E05F 2015/767* (2015.01); *E05Y 2400/54* (2013.01); *E05Y 2900/104* (2013.01); *E05Y 2900/132* (2013.01)

(58) Field of Classification Search
CPC ..... E05F 2015/767; E05Y 2900/104; E05Y 2900/132
See application file for complete search history.

(56) References Cited

U.S. PATENT DOCUMENTS

RE30,719 E * 8/1981 Mills ..... B66B 13/26 187/317
4,697,383 A * 10/1987 Hagiwara ..... E05F 15/73 49/25
4,847,485 A * 7/1989 Koelsch ..... G07C 9/00 250/221
4,851,746 A * 7/1989 Milke ..... G01S 17/04 318/467
RE33,668 E * 8/1991 Gray ..... B66B 13/26 187/317
5,142,152 A * 8/1992 Boiucaner ..... G08B 13/187 250/221
5,149,921 A * 9/1992 Picado ..... B66B 13/26 187/317
5,235,143 A * 8/1993 Bahjat ..... B66B 13/143 187/316
5,286,930 A * 2/1994 Bittar ..... B66B 13/143 187/316
5,387,768 A * 2/1995 Izard ..... G06F 7/00 187/392
5,410,149 A * 4/1995 Winston, Jr. ..... B66B 13/26 250/221
5,583,405 A * 12/1996 Sai ..... G01S 15/876 318/286
5,644,111 A * 7/1997 Cerny ..... B66B 13/14 187/280
5,886,307 A * 3/1999 Full ..... B66B 13/26 187/317
5,925,858 A * 7/1999 Full ..... B66B 13/26 187/317
5,963,000 A * 10/1999 Tsutsumi ..... E05F 15/73 250/221
6,051,829 A * 4/2000 Full ..... B66B 13/26 187/317
6,080,981 A 6/2000 Payne
6,167,991 B1 * 1/2001 Full ..... B66B 13/26 187/317
6,304,178 B1 * 10/2001 Hayashida ..... G01V 8/10 340/545.1
6,344,642 B1 * 2/2002 Agam ..... G01S 15/46 250/221
6,386,326 B2 * 5/2002 Pustelniak ..... B66B 13/26 187/317
6,525,659 B2 2/2003 Jaffe et al.
6,812,837 B2 11/2004 Ikeuchi
7,042,492 B2 * 5/2006 Spinelli ..... H04N 7/183 348/143
7,165,655 B2 1/2007 Cook et al.
7,762,022 B2 7/2010 Stadler et al.
7,992,687 B2 8/2011 Yumura et al.
8,630,741 B1 1/2014 Matsuoka et al.
8,833,524 B2 * 9/2014 De Coi ..... B66B 13/26 187/316
8,955,253 B2 2/2015 Kanki et al.
2001/0045327 A1 * 11/2001 Shemanske, II ..... H04N 7/188 187/317
2006/0203615 A1 * 9/2006 Gal ..... G01S 7/52004 367/98
2007/0094932 A1 * 5/2007 Hoshide ..... E05F 15/73 49/370
2009/0057068 A1 * 3/2009 Lin ..... B66B 1/34 187/392
2010/0319256 A1 * 12/2010 Agam ..... G01S 15/04 49/31
2013/0075201 A1 3/2013 Lee et al.
2013/0263511 A1 * 10/2013 Agam ..... G01S 7/527 49/31
2016/0031675 A1 * 2/2016 Silvennoinen ..... B66B 1/468 187/247
2016/0217663 A1 * 7/2016 Shichiri ..... G07C 9/15
2016/0289043 A1 * 10/2016 Fang ..... G06T 7/50
2016/0289044 A1 * 10/2016 Hsu ..... B66B 1/2408
2016/0292522 A1 * 10/2016 Chen ..... B66B 1/3476
2017/0074039 A1 3/2017 Gregoriou
2020/0048045 A1 * 2/2020 Xiong ..... B66B 1/2408

OTHER PUBLICATIONS

Yang, et al., "An Intelligent Automated Door Control System Based on a Smart Camera," Sensors 2013, 13, pp. 5923-5936.

* cited by examiner

ZONE OBJECT DETECTION SYSTEM FOR ELEVATOR SYSTEM

BACKGROUND

The embodiments herein relate to elevator systems and, more particularly, to a zone object detection system for use with automated door systems.

Current door systems require obstruction detection in the closing door plane, leading to passengers putting hands in the door path to stop the door. On occasion, this may lead to a passenger intentionally or inadvertently contacting the door. Elevator doors are typically equipped with detection components that only monitor for objects in the plane of the elevator door.

BRIEF SUMMARY

Disclosed is a zone object detection system including a passenger compartment. Also included is a door moveable between an opened position and a closed position. Further included is a first sensor monitoring a first zone outside of a plane of the door. Yet further included is a second sensor monitoring a second zone comprising at least one of the plane of the door and outside of the plane of the door. Also included is a controller in operative communication with the first sensor and the second sensor, the controller commanding a first modification of a door closing movement of the door if an object is detected in the first zone, the controller commanding a second modification of the door closing movement of the door if an object is detected in the second zone.

In addition to one or more of the features described above, or as an alternative, further embodiments may include that the first modification is one of reducing a speed of the door closing movement, stopping the door closing movement, and reversing the door closing movement, wherein the second modification is one of reducing a speed of the door closing movement, stopping the door closing movement, and reversing the door closing movement, the first modification being distinct from the second modification.

In addition to one or more of the features described above, or as an alternative, further embodiments may include that the first zone is located further away from the door, relative to the distance from the second zone to the door, the first modification comprising reducing the speed of the door closing movement, the second modification comprising reversing the movement of the door to open the door.

In addition to one or more of the features described above, or as an alternative, further embodiments may include that each of the first sensor and the second sensor is one of an infrared sensor, a radar sensor, a video sensor, a time of flight sensor, and a LIDAR sensor.

In addition to one or more of the features described above, or as an alternative, further embodiments may include that the first zone and the second zone are each located at an exterior of the passenger compartment.

In addition to one or more of the features described above, or as an alternative, further embodiments may include that the first zone and the second zone are each located at an interior of the passenger compartment.

In addition to one or more of the features described above, or as an alternative, further embodiments may include that the second zone is an area in the plane of the door.

In addition to one or more of the features described above, or as an alternative, further embodiments may include that the first zone is located at an interior of the passenger compartment, the second zone is located at an exterior of the passenger compartment.

In addition to one or more of the features described above, or as an alternative, further embodiments may include that the passenger compartment is an elevator car and the door is an elevator door, wherein the first sensor is fixed to one of the elevator door, the leading edge of the elevator door, and a fixed structure in a landing area located proximate the elevator door.

In addition to one or more of the features described above, or as an alternative, further embodiments may include that the first zone and the second zone have different volumes.

In addition to one or more of the features described above, or as an alternative, further embodiments may include that the first zone is wider than the second zone and/or deeper than the second zone.

In addition to one or more of the features described above, or as an alternative, further embodiments may include that the second zone is wider than the first zone and/or deeper than the first zone.

Also disclosed is a zone object sensing assembly for a door of a passenger compartment. The assembly includes a door moveable between an opened position and a closed position. Also included is at least one sensor monitoring a first zone comprising an area at an exterior of the passenger compartment outside of a plane of the door and a second zone comprising an area at an interior of the passenger compartment outside of the plane of the door. Further included is a controller in operative communication with the at least one sensor, the controller commanding a first modification of a door closing movement of the door if an object is detected in the first zone or the second zone.

In addition to one or more of the features described above, or as an alternative, further embodiments may include that the at least one sensor comprises a first sensor monitoring the first zone and a second sensor monitoring the second zone, the first and second sensors are each one of an infrared sensor, a radar sensor, a video sensor, a time of flight sensor, and a LIDAR sensor.

In addition to one or more of the features described above, or as an alternative, further embodiments may include a third zone located further away from the door at the exterior of the passenger compartment, relative to the distance from the first zone to the door, the first modification comprising reducing the speed of the door closing movement, the second modification comprising reversing the movement of the door to open the door.

In addition to one or more of the features described above, or as an alternative, further embodiments may include a fourth zone located further away from the door at the interior of the passenger compartment, relative to the distance from the second zone to the door, the first modification comprising reducing the speed of the door closing movement, the second modification comprising reversing the movement of the door to open the door.

In addition to one or more of the features described above, or as an alternative, further embodiments may include that the at least one sensor is fixed to the door.

In addition to one or more of the features described above, or as an alternative, further embodiments may include that the at least one sensor is fixed to a leading edge of the door.

In addition to one or more of the features described above, or as an alternative, further embodiments may include that the at least one sensor is fixed to a fixed structure in a landing area located proximate the door.

Further disclosed is a method of detecting objects proximate an elevator door. The method includes monitoring a first zone of a landing area out of a plane of the elevator door with a first sensor. Also included is monitoring a second zone of the landing area out of the plane of the elevator door with a second sensor. Further included is reducing a closing speed of the elevator door if an object is detected in the first zone. Yet further included is reversing a closing movement of the elevator door if an object is detected in the second zone.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
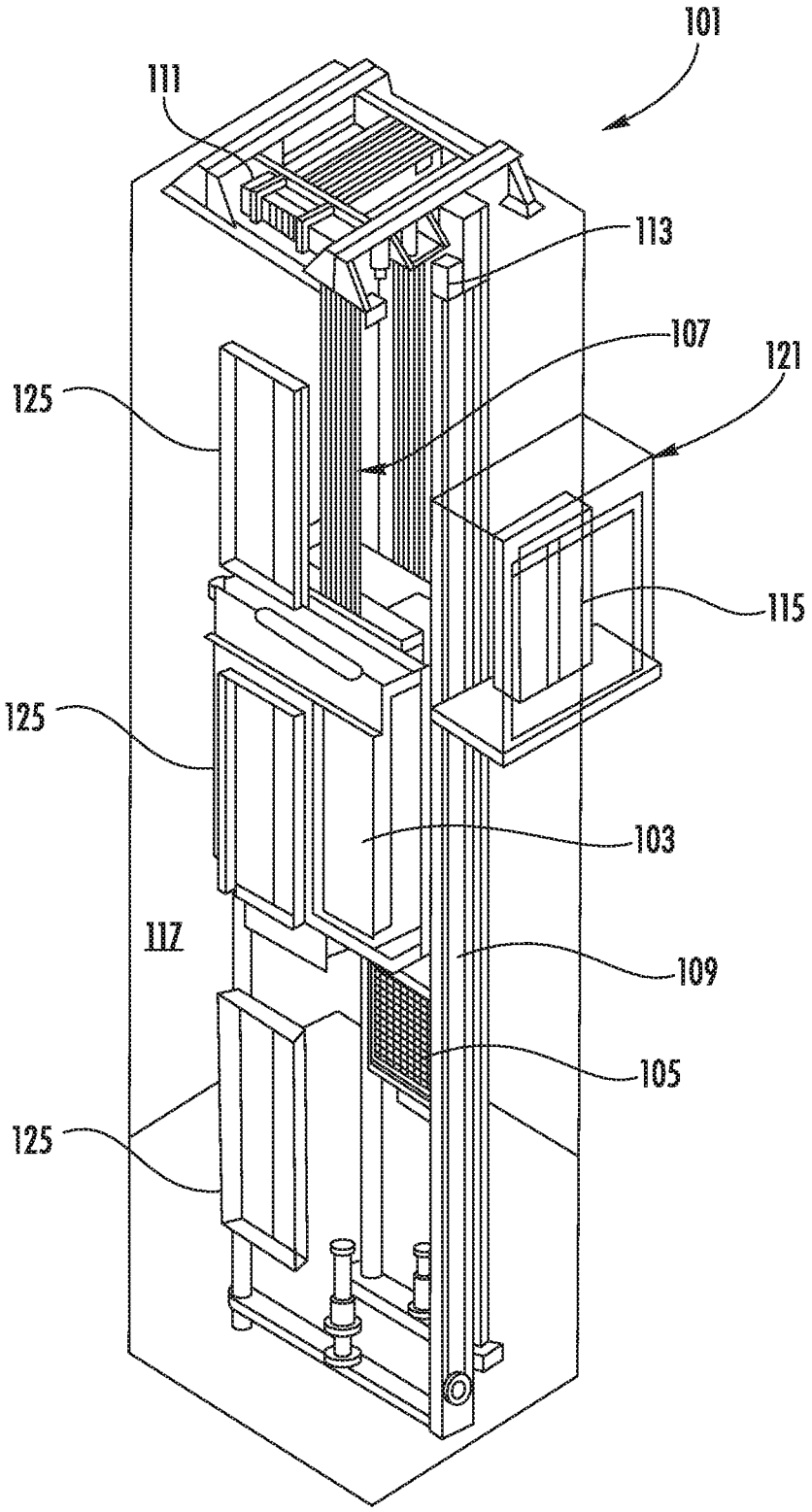
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
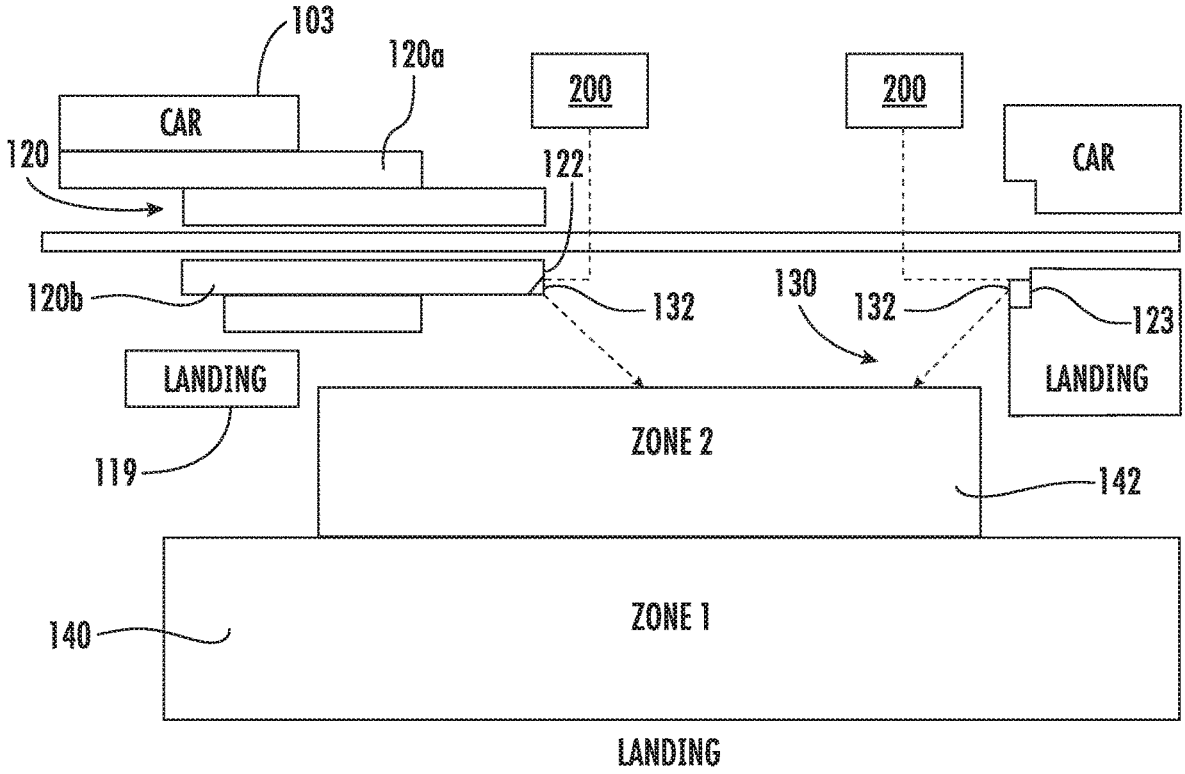
FIG. 2 is a schematic illustration of a zone object detection system associated with the elevator system.

Referring now to FIG. 2, a top plan view of an environment associated with loading and unloading of the elevator car 103, such as a building lobby or floor landing area (referred to herein as a "landing"), is shown. FIG. 2 illustrates a portion of the elevator car 103, a landing 119, and an elevator door 120. The elevator door 120 refers to a tandem door system that includes an elevator car door **120*a* and a landing area door 120*b* in some embodiments. The embodiments described herein may be applied to either door and for ease of understanding, the doors 120*a*, 120*b* are collectively referred to as the elevator door 120. In the illustrated embodiment, the elevator car 103 includes a single elevator door 120 that may be translated between an opened position and a closed position. In such an embodiment, a leading edge 122 of the door 120 moves toward a wall 123 of the landing 119 during a closing action and away from the wall 123** during an opening action. It is to be appreciated that some embodiments include two doors that move toward each other door during a closing action and away from the other door during an opening action.

A zone object detection system 130 is schematically illustrated in FIG. 2. As one will appreciate from the disclosure herein, the zone object detection system 130 modifies behavior/operation of the elevator door(s) 120 based on zone recognition, and transitions of objects between multiple zones in some embodiments. Various modes of door behavior modification are contemplated and are described in detail herein.

Although the illustrated embodiment pertains to an elevator door, it is contemplated that any type of automated door that opens and closes in response to passengers entering or exiting a compartment may benefit from the embodiments described herein. For example, a train (e.g., subway car or large passenger train), building entrance/exit, and any other automated door system may utilize the embodiments described herein.

The zone object detection system 130 includes one or more sensors 132 that monitor one or more zones that are in and/or out of the elevator door plane. In systems where multiple sensors are employed, the sensors 132 may be a common type of sensor or varied. Any type of sensor suitable for moveable object detection may be employed. For example, sensors that rely on infrared, radar, video, LIDAR, time of flight, floor pressure sensors, and suitable alternatives, may be utilized. The sensors 132 may be positioned in various locations. For example, the sensors 132 may be located on the floor of the landing 119, or at elevated positions fixed to a structure in the landing 119. In the illustrated embodiment, a sensor 132 is fixed to the elevator door 120 proximate the leading edge 122 of the door (which may be either or both of door 120*a*, 120*b*), and fixed to the landing wall 123. Other locations are certainly possible. Sensors in multi-zone detection systems can be tandem sensors designed to send signals in parallel, or can be video systems that determine passenger intent in real time, sending multiple signals to a door controller 200 as a passenger or object approaches.

The illustrated embodiment of FIG. 2 shows two zones that are monitored, namely a first zone 140 and a second zone 142, with the second zone 142 being located closer to the elevator door 120, relative to the distance from the first zone 140 to the elevator door 120. The zones may be of any dimension (width, height and/or depth) suitable for a particular application of use, which may vary depending upon particular circumstances, including environment dimensions and geometry, door closing speed, door closing distance, etc. For example, the depth of the zone(s) may be up to a certain distance (e.g., up to 20 inches from elevator door) or may be a function of the width of the zone (e.g., 20% of the zone width); however, it is to be appreciated that each dimension may deviate from the non-limiting examples provided. Additionally, the sizes of the zones may vary from each other. For example, the zone closest to the elevator door 120 may be approximately the width of the elevator door 120, but the zone(s) further from the elevator door 120 may be wider than the closer zone to monitor a broader path that may include objects moving toward the elevator door at various angles. In a non-limiting embodiment, the more distant zone may be up to 20% wider than the closer zone, but this relative dimensioning may vary.

Regardless of the zone sizes and dimensions relative to each other, the sensors 132 monitor the zones 140, 142 to detect objects located within, and moving within, either of the zones. The sensors 132 are in operative communication with the door controller 200 to determine the elevator door's 120 response to incoming passengers. In one embodiment, if a person is detected within the first zone 140 during a closing action of the elevator door 120, the controller will command the elevator door 120 to slow down from its normal closing speed. A reduction in closing speed better prepares the elevator door 120 for stopping and/or reversing, if needed. If the person continues to approach the elevator door 120 and enters the second zone 142, the controller 200 stops and/or reverses the already slowed door movement, as the detection of a presence in the second zone 142 is perceived as an oncoming passenger.

The embodiment described above reduces potential issues with immediate reversal of an elevator door that is closing at full speed, thereby reducing the likelihood of impact with the person or object entering the elevator car 103.

As one can appreciate, more than two zones may be defined and monitored by the zone object detection system 130 disclosed herein. In particular, a multi-stage slowing of the elevator door may be present, with slowing of a closing door to a first reduced speed, relative to full closing speed, if a person is in a first zone, and subsequent slowing to even slower closing speeds if the person enters one or more closer zones. Stopping and reversing the door closing movement may be additional commands that occur subsequent to slowing over one or more reduction speeds. Additionally, a single zone may be defined and monitored. In a single zone, slowing, stopping or reversal of the elevator closing may occur in response to detection of an object within the single zone.

Regardless of the number of zones defined and monitored, the total distance away from the elevator door 120 that is monitored may vary depending upon the particular requirements of a specific elevator system. In some embodiments, a distance of up to about 3 meters is monitored, but it is to be appreciated that other distances may be defined as the zone(s) for monitoring. In multi-zone embodiments, the total distance monitored may be broken up into the different zones in any distance combination considered desirable for the particular elevator system.

The embodiments described above relate to objects approaching the elevator door 103 from the landing area 119. However, it is to be appreciated that a reversed situation may be present in some embodiments. In particular, monitoring potentially exiting objects within the elevator car 103 may be provided in some embodiments. For example, one or more zones may be present in the interior of the elevator car 103 itself. Additionally, it is to be understood that any combination of interior zones and exterior zones may be provided. For example, one or more zones within the interior of the elevator car may be combined with one or more zones at an exterior of the elevator car.

Monitoring for objects out of the plane of the elevator door 120 reduces the probability of passenger impact, as the system provides more time to slow, stop and/or reverse a closing door. This increases passenger safety and experience.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A zone object detection system comprising:

a passenger compartment;

a door moveable between an opened position and a closed position;

a first sensor monitoring a first zone outside of a plane of travel of the door;

a second sensor monitoring a second zone comprising at least one of the plane of travel of the door and outside of the plane of travel of the door; and a controller in operative communication with the first sensor and the second sensor, the controller commanding a first modification of a door closing movement of the door if an object is detected in the first zone, the controller commanding a second modification of the door closing movement of the door if an object is detected in the second zone;

wherein the first zone is located further away from the door, relative to the distance from the second zone to the door, the first modification comprising reducing the speed of the door closing movement, the second modification comprising reversing the movement of the door to open the door.

2. The zone object detection system of claim 1, wherein each of the first sensor and the second sensor is one of an infrared sensor, a radar sensor, a video sensor, a time of flight sensor, and a LIDAR sensor.

3. The zone object detection system of claim 1, wherein the first zone and the second zone are each located at an exterior of the passenger compartment.

4. The zone object detection system of claim 1, wherein the first zone and the second zone are each located at an interior of the passenger compartment.

5. The zone object detection system of claim 1, wherein the second zone is an area in the plane of travel of the door.

6. The zone object detection system of claim 1, wherein the first zone is located at an interior of the passenger compartment, the second zone is located at an exterior of the passenger compartment.

7. The zone object detection system of claim 1, wherein the passenger compartment is an elevator car and the door is an elevator door, wherein the first sensor is fixed to one of the elevator door, the leading edge of the elevator door, and a fixed structure in a landing area located proximate the elevator door.

8. The zone object detection system of claim 1, wherein the first zone and the second zone have different volumes.

9. The zone object detection system of claim 8, wherein the first zone is wider than the second zone and/or deeper than the second zone.

10. The zone object detection system of claim 8, wherein the second zone is wider than the first zone and/or deeper than the first zone.

11. A zone object sensing assembly for a passenger compartment comprising:

a door moveable between an opened position and a closed position;

at least one sensor monitoring a first zone comprising an area at an exterior of the passenger compartment outside of a plane of travel of the door and a second zone comprising an area at an interior of the passenger compartment outside of the plane of travel of the door; and a controller in operative communication with the at least one sensor, the controller commanding a first modification of a door closing movement of the door if an object is detected in the first zone or the second zone;

a third zone located further away from the door at the exterior of the passenger compartment, relative to the distance from the first zone to the door, the first modification comprising reducing the speed of the door closing movement, the controller commanding a second modification of the door closing movement of the door if the object is detected in the third zone, the second modification comprising reversing the movement of the door to open the door.

12. The zone object sensing system of claim 11, wherein the at least one sensor comprises a first sensor monitoring the first zone and a second sensor monitoring the second zone, the first and second sensors are each one of an infrared sensor, a radar sensor, a video sensor, a time of flight sensor, and a LIDAR sensor.

13. The zone object detection system of claim 11, further comprising a fourth zone located further away from the door at the interior of the passenger compartment, relative to the distance from the second zone to the door, the first modification comprising reducing the speed of the door closing movement, the controller commanding the second modification of the door closing movement of the door if the object is detected in the fourth zone.

14. The zone object detection system of claim 11, wherein the at least one sensor is fixed to the door.

15. The zone object detection system of claim 14, wherein the at least one sensor is fixed to a leading edge of the door.

16. The zone object detection system of claim 11, wherein the at least one sensor is fixed to a fixed structure in a landing area located proximate the door.

* * * * *